United States Patent [19]

Inoue et al.

[11] Patent Number: 4,677,339

[45] Date of Patent: Jun. 30, 1987

[54] COLOR CATHODE RAY TUBE

[75] Inventors: Masatsugu Inoue; Hidetoshi Yamazaki, both of Fukaya, Japan

[73] Assignee: Kabushiki Kaisha Toshiba, Kawasaki, Japan

[21] Appl. No.: 775,269

[22] Filed: Sep. 12, 1985

[30] Foreign Application Priority Data

Sep. 13, 1984 [JP] Japan ..... 59-190696

[51] Int. Cl.[4] ..... H01J 29/07

[52] U.S. Cl. ..... 313/402; 313/408; 313/303

[58] Field of Search ..... 313/402, 403, 408, 477

[56] References Cited

U.S. PATENT DOCUMENTS

| | | | |
|---|---|---|---|
| 3,889,145 | 6/1975 | Suzuki et al. | 313/403 |
| 3,925,700 | 12/1975 | Saito | 313/403 |
| 3,947,718 | 3/1976 | Van Lent | 313/403 |
| 4,136,300 | 1/1979 | Morrell | 313/403 |
| 4,162,421 | 7/1979 | Morell | 313/403 |
| 4,173,729 | 11/1979 | Stone et al. | 313/403 |

FOREIGN PATENT DOCUMENTS

| | | | |
|---|---|---|---|
| 2827690 | 1/1979 | Fed. Rep. of Germany . | |
| 212357 | 8/1980 | Fed. Rep. of Germany . | |
| 1589841 | 5/1982 | Fed. Rep. of Germany | 313/408 |
| 49764 | 4/1977 | Japan | 313/403 |
| 49062 | 4/1979 | Japan | 313/402 |
| 75539 | 4/1984 | Japan | 313/403 |
| 59-163737 | 9/1984 | Japan . | |
| 165341 | 9/1984 | Japan | 313/402 |
| 60-9035 | 1/1985 | Japan . | |
| 60-177534 | 9/1985 | Japan . | |

*Primary Examiner*—Jerry W. Myracle
*Assistant Examiner*—Hezron E. Williams
*Attorney, Agent, or Firm*—Oblon, Fisher, Spivak, McClelland & Maier

[57] ABSTRACT

In a color cathode ray tube with a shadow mask shaped as a nonspherical surface, a structure in which the curved surface shape of the effective area of the shadow mask in which apertures through which electron beams pass to a fluorescent screen are formed is made such that, going along the X axis, minimal values of radius of curvature of lines of intersection of the shadow mask and Y-Z parallel planes parallel to the minor axis Y and a central axis which passes through the mask's center and is normal to the mask exist between the center and the edges of the effective area. This prevents local doming.

5 Claims, 9 Drawing Figures

COLOR CATHODE RAY TUBE

BACKGROUND OF THE INVENTION

The present invention relates to a shadow mask type colour cathode ray tube and more particularly to a curved shape therein.

A shadow mask employed in a shadow mask type colour cathode ray or picture tube is an important element possessing a colour selection function, In more detail, a shadow mask constituted by an effective surface portion that has a substantially rectangualr frame and has formed therein a large number of apertures in a regular array is provided at a set distance from a curved panel inner surface that has a substantially rectangular frame and has applied thereon individual phosphors for emitting a number of colours. A plurality of electron beams from electron guns provided in the neck portion of the tube are focussed and accelerated and are subjected to a deflection action cause them to scan a substantially rectangular area and to pass through the shadow mask apertures to strike and cause emission of light by corresponding phosphors and thereby produce an image. In order to ensure so-called beam landing between the set of shadow mask apertures and the set of corresponding phosphors, it is necessary that they be in a specific relative positional relation, which must be kept constant during operation of the picture tube. More specially, the interval between the shadow mask and the fluorescent surface (referred to as the q value below) must always be within a set permissible range. However, from the principle of operation of a shadow mask type colour picture tube, only one third or less of the electron beams pass through the shadow mask and the remainder strike portions of the shadow mask where there are no apertures, are converted to thermal energy and heat and cause expansion (referred to below as doming) of the mask. Consequently, if the position of the shadow mask, which is generally made of metal having iron as its main component, changes to the extent that the q value is outside the permissible range because of heating and expansion, the result is deterioration of the colour purity because of misalignment of the beam landing positions. The magnitude of this mislanding caused by thermal expansion of a shadow mask varies considerably depending on the image pattern on the screen and the length of time this pattern continues.

Mislanding caused by heating effects extending from the shadow mask to the mask frame which supports the shadow mask, and which possesses a large heat capacity, requires a comparatively long time and an effective method of compensating this is to include bimetal in the spring support structure mounted on the mask frame, as disclosed in Japanese Patent Publication No. 44-3547. However, mislanding that is brought about in a comparatively short time, e.g., local mislanding due to local doming caused by very bright local displays, is a considerable problem.

In connection with mislanding that occurs in a short time, if use is made of a signal unit for generating rectangular window-shaped patterns and the magnitude of mislanding is measured for different shapes and positions of the window-shaped patterns, it is found that mislanding is comparatively small when there is a large-current beam pattern 5 over practically the entire surface of the screen 6 as shown in FIG. 6 and that the greatest mislanding occurs when there is a large-current beam raster pattern 5 that is comparatively long and narrow and is displayed slightly toward the centre from the left or right-hand edge of the screen periphery as shown in FIG. 7. This can be understood from the following reasons.

Firstly, since a TV receiver is designed so that the picture tube's average anode current will not exceed a set value, the current per unit area of the shadow mask is smaller with a large window-shaped pattern as in FIG. 6 than it is in the case of FIG. 7 and so the temperature rise is small.

Secondly, if a pattern is in the middle of the screen, it if difficult for mislanding to occur even if the shadow mask is thermally deformed, but the degree to which thermal deformation of the shadow mask appears as mislanding on the screen becomes greater as the pattern moves from the centre towards the left or right-hand edges. However, actual deformation near the left and right-hand edges of the screen is small, since the shadow mask is fixed to the mask frame in these locations. Thus, the greatest mislanding occurs in the case of window-shaped patterns in a position like that shown in FIG. 7.

FIG. 8 is a drawing for the purpose of explaining the form mislanding takes in the case of a pattern such as shown in FIG. 7. A shadow mask 136 is held in a facing relation to the inner surface wall of a panel 124 by a mask frame 134 making use of stud pins 125 and spring support structures 135.

During operation at low luminance, i.e., when the electron current density is small, the shadow mask 136 is in position a1 and an electron beam 142 at position c1 passes through an aperture 137 and lands correctly on a corresponding phosphor dot 130. On a change from this state to display of a pattern with high local luminance such as shown in FIG. 7, local heating and expansion of the shadow mask 136 occurs, so resulting indisplacement of the shadow mask to position a2 and displacement of the aperture 137 from position b1 to b2, in consequence of which the electron beam 14 that passes through the aperture 137 shifts from position c1 to c2 and there is no longer accurate landing on the set phosphor dot.

There is a procedure employed for preventing this short time thermal deformation of the shadow mask, which is to make the portions where the shadow mask is fixed to the mask frame as flexible as possible so that instead of there being doming deformation indicated by the dashed line 136*a* in FIG. 9(*a*) the shadow mask 136 as a whole moves parallel to the tube axis as indicated by the dashed line 136*b* in FIG. 9(*b*). However, although such a measure is effective against displacement caused by thermal expansion of the whole surface of the mask as in FIG. 9(*a*) or (*b*), it is of practically no effect against local displacement such as occurs in the case shown in FIG. 7. This trend becomes more marked as tubes are larger and have larger screens. Also, for a given size, it is more marked as the shadow mask's radius of curvature is larger, i.e., as the tube is flatter, which is considered preferable for visual perception.

SUMMARY OF THE INVENTION

It is the object of the present invention to provide a novel shadow mask curved shape which suppresses deterioration of colour purity caused by local thermal deformation of a shadow mask due to impact of electron beams and, in addition to this, to provide a panel curved shape.

The colour cathode ray tube of the invention relates to a colour cathode ray tube which comprises a substantially rectangular curved panel which has a fluorescent screen formed on its inner surface and has its central axis the centre of and going in a direction normal to this screen and a shadow mask with a nonspherical curved surface which is mounted via a substantially rectangular frame in a position such that the central axis passes through the mask centre and possesses an effective area having formed therein a large number of apertures permitting passage of electron beams. Taking the mask centre of the shadow mask as a point of origin, its major axis as the X axis, its minor axis as the Y axis and the central axis as the Z axis, that area in the effective area which is in the vicinity of the intersection of the plane containing the X axis and the Z axis (the X-Z plane) and the effective area is so shaped that minimal values of the radius of curvature of lines of intersection defined by the effective area and arbitrary planes that are parallel to the Y axis and the Z axis (Y-Z plane) exist between the mask centre and the edges of the effective area in X axis direction. It is also possible to match the curved shape of the panel inner surface defining a fluorescent screen to the shape of the shadow mask, and to similarly make the radius of curvature of lines of intersection with Y-Z planes have minimal values in positions corresponding to the shadow mask's minimal values.

This structure makes it possible to reduce thermal deformation at places where local doming in regions near the X axis is maximum and hence to effectively suppress colour purity deterioration.

DETAILED DESCRIPTION OF PREFERRED EMBODIMENTS

Figure 1:
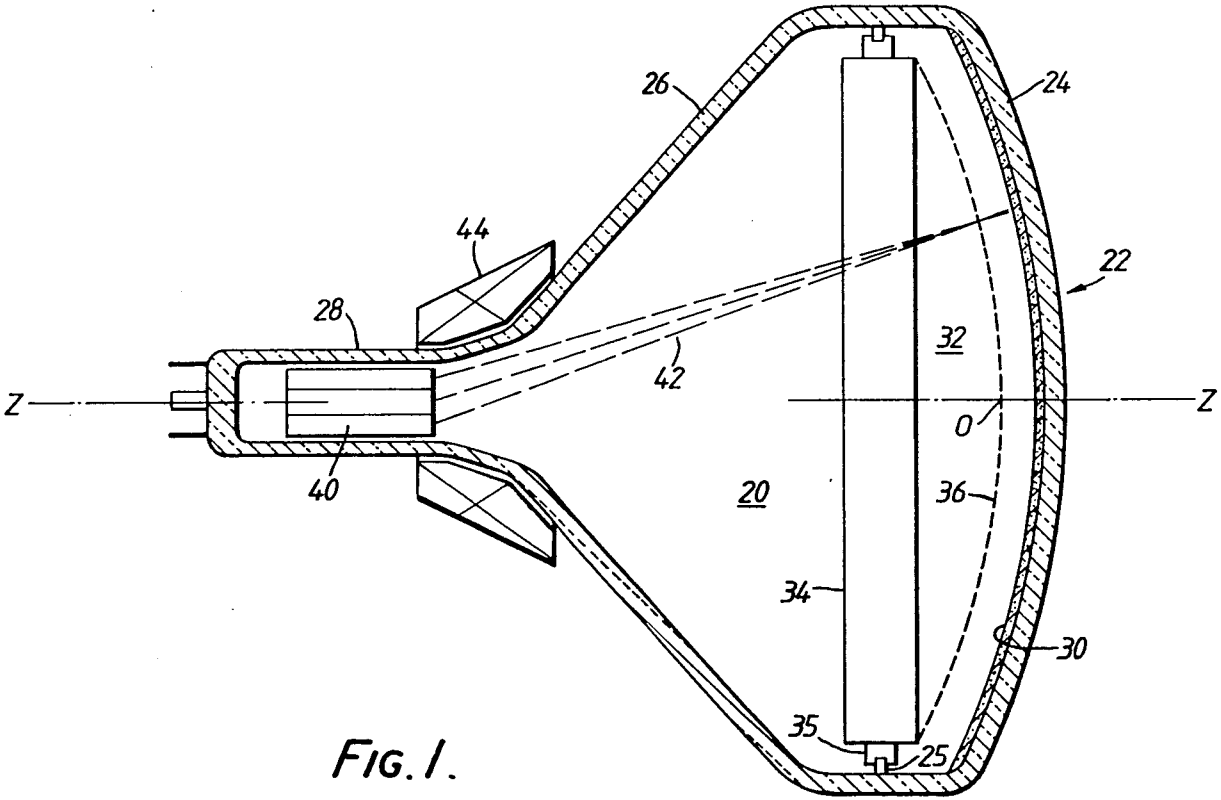
FIG. 1 is a longitudinal cross-section of one embodiment of the invention.
Figure 2:
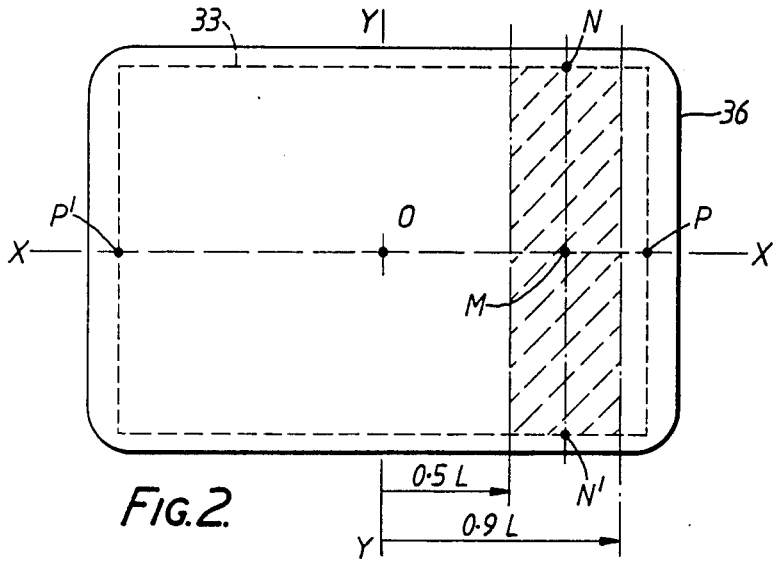
FIG. 2 is a plane view of the shadow mask seen from the fluorescent screen side in FIG. 1.

Referring to FIG. 1, a colour cathode ray tube 20 constituting an embodiment of the invention has a glass envelope 22 comprising an approximately rectangular panel 24, a funnel 26 and a neck portion 28. The inner surface of panel 24 forms a spherically curved depressed surface on which is provided a fluorescent screen 30 with phosphor dots of three colours arranged on it in a regular array. These phosphor dots constitute alternately disposed stripes of phosphors that emit red, green and blue. Normally, the direction of stripes is the vertical direction as seen in FIG. 2, i.e., the direction of the minor axis Y. A shadow mask structure 32 is mounted near screen 30. Shadow mask structure 32 consists of a rectangular frame 34 and a shadow mask 36 that has many apertures formed in it and is elastically mounted by spring support elements 35 on stud pins 25 embedded in the skirt portion of panel 24. The apertures are formed in slits going in the direction of the Y axis in correspondence to the stripes of the fluorescent screen and define a rectangular area 33 indicated by the dashed line in FIG. 2 which constitutes the effective area for image display.

In-line type electron guns 40 are mounted in neck portion 28 and emit three electron beams 42 which pass through the apertures of shadow mask 36 and strike the fluorescent screen 30. These electron beams 42 are deflected by a deflection yoke 44 mounted on the outside wall of funnel 26 and scan shadow mask 32 and fluorescent screen 30.

Figure 3:
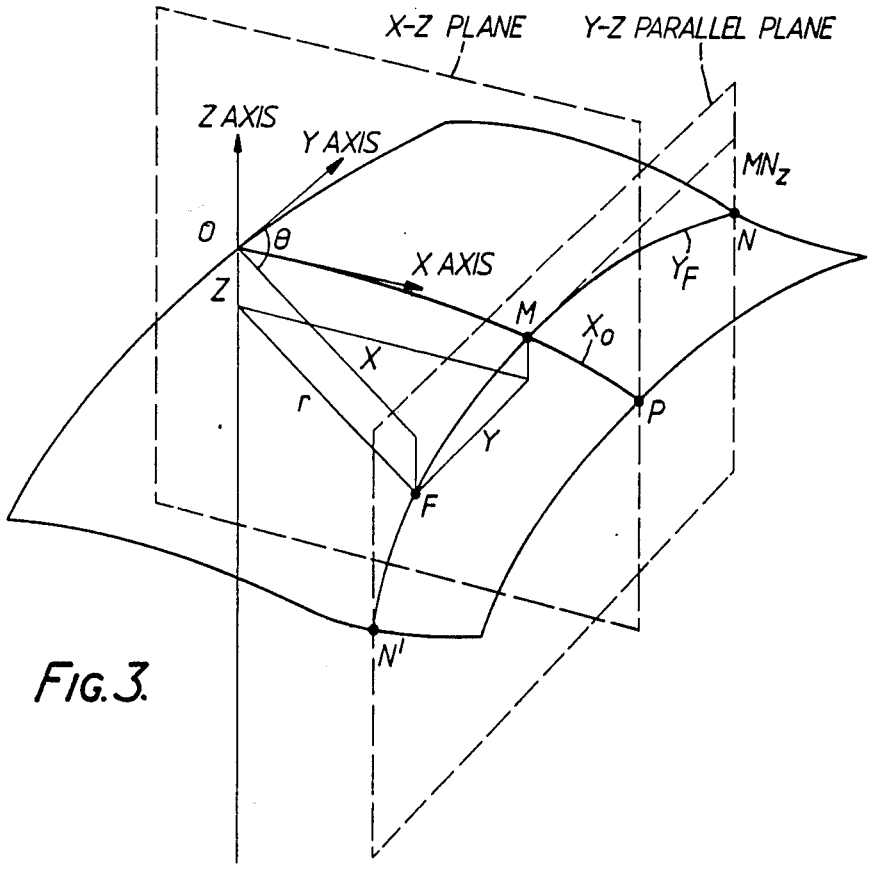
FIG. 3 is a drawing for explaining the shape of the shadow mask of FIG. 2 and is a perspective view of half the surface of the effective area of the shadow mask.

Taking the tube axis, i.e., the central axis that is normal to the screen at the centre of screen 30, as shadow mask 36 is mounted in a position such that this Z axis passes normally through the shadow mask centre 0. As shown in FIGS. 2 and 3, the rectangular shadow mask's major axis going horizontally is designated as the X axis, the minor axis going vertically as the Y axis and the mask centre 0 as the point of origin.

In FIG. 3, the distance components along the X, Y and Z axes from the centre 0 of shadow mask 36 to a point F on mask 36 are designated as X, Y and Z. If the radius of curvature at point F of the line of intersection formed by a plane that passes through point F from the Z axis cutting shadow mask 36 is designated as R, from conventional partial spherical surfaces, to optimize the q value it is simply necessary to make the shape of the curved surface a shape representable by $$Z = \{R - \sqrt{R^2 - r^2}\} \tag{1}$$

$$R = A + B\cos 2\theta + C\cos 4\theta$$

$$r^2 = X^2 + Y^2$$

or $$Z = -\{R_H - \sqrt{R_H^2 - X^2} + (R_{V0} + kX^2) - \sqrt{(R_{V0} + kX^2)^2 - Y^2}\} \tag{2}$$

etc., where $\theta$: angle with respect to Y axis
$R_H$ : radius of arc on major axis
$R_{VO}$ : radius of arc on minor axis
A,B,C,k : constants
r : distance from Z axis In a shadow mask with a shape like this, the radius of curvature of the line of intersection $Y_F$ formed by the effective area and an arbitrary plane parallel to the Y axis and Z axis (Y-Z parallel plane) in the vicinity of the line of intersection $X_0$ of the plane containing the X axis and Z axis (X-Z plane) and the effective area decreases monotonically going from the mask centre 0 toward the edge P of the effective area or it increases monotonically or has a maximal value at an intermediate point.

Figure 5:
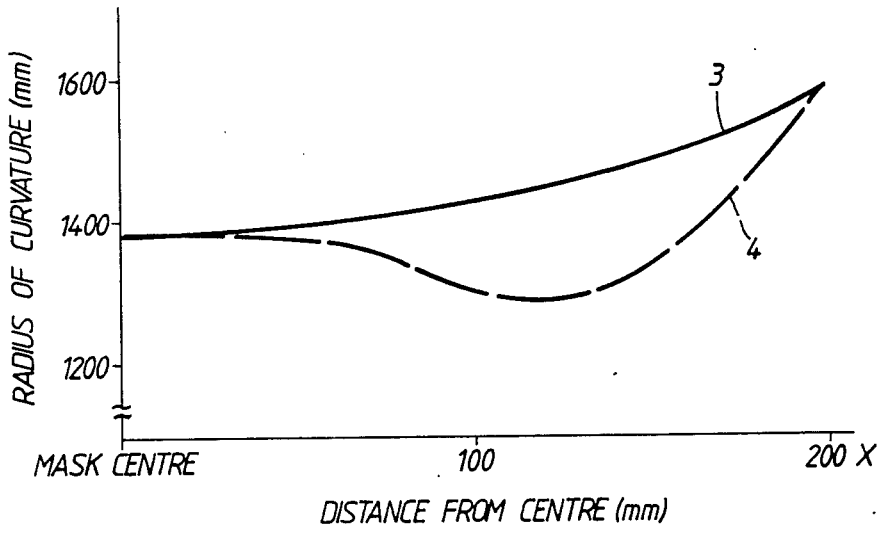
FIG. 5 is a graph for the purpose of explanation of the invention which plots the radius of curvature of intersections defined by the effective area and shadow mask Y-Z parallel planes.
Figure 6:
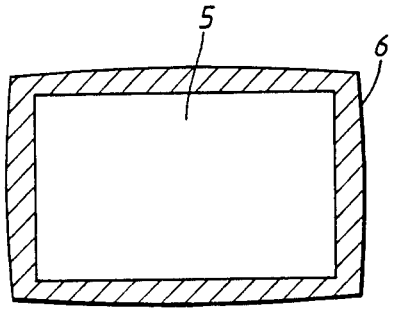
FIG. 6 is a sketch showing a plane view of a display pattern on a colour cathode ray tube screen.

For example, a shape representable by Equation (2) is used in a 21" colour cathode ray tube and the radius of curvature of the shadow mask and the radius of the shadow mask going along the X axis on a Y-Z parallel plane increases monotonically, as indicated by curve 3 in FIG. 5.

Figure 7:
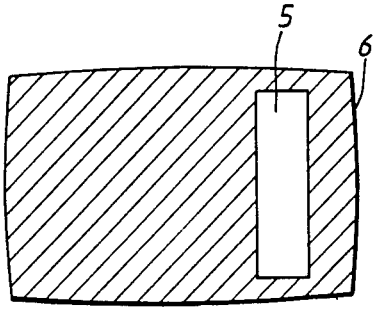
FIG. 7 is a sketch showing a plane view of another display pattern on a colour cathode ray tube screen.
Figure 8:
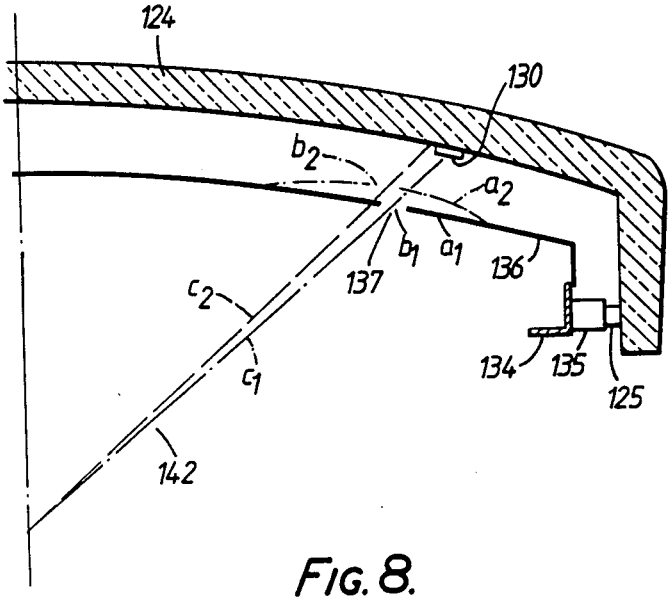
FIG. 8 model sketch for explanation of local thermal deformation of a shadow mask that occurs in display of the pattern of FIG. 7.
Figure 9:
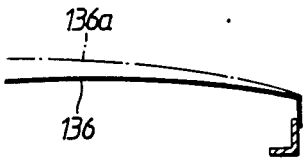
FIG. 9 is a drawing for explaining whole-surface deformation of a shadow mask and shows (a) type and (b) type deformation.
Figure 9:
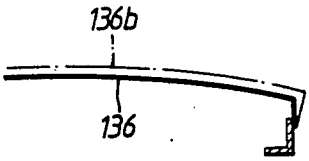

This will now be described in further detail with reference to FIG. 7 and FIG. 8. When a raster pattern 5 that is near one side as shown in FIG. 7 is displayed, for the first 2 to 3 minutes there is thermal expansion, with consequent mislanding, only of the pattern area 5 of the shadow mask 136 struck by electron beams, as illustrated in FIG. 8. If actual measurements of the temperature rise of the shadow mask 136 raster pattern portion at this time are made, it is found that in conditions in which point M on the X axis at the centre rises to about 70° C. the temperature rises about 25° C. at the point N and N' (FIG. 2) are the top and bottom edges of the effective area, i.e., at the opposite edges of the raster pattern on the Y-Z parallel plane, from which it is appreciated that within the region 5 thermal expansion is greater in the vicinity of the X axis than it is in portions that are removed from the X axis. In other words, thermal deformation of the area 5 as a whole can be made small if deformation in the vicinity of the X axis is made small.

Figure 4:
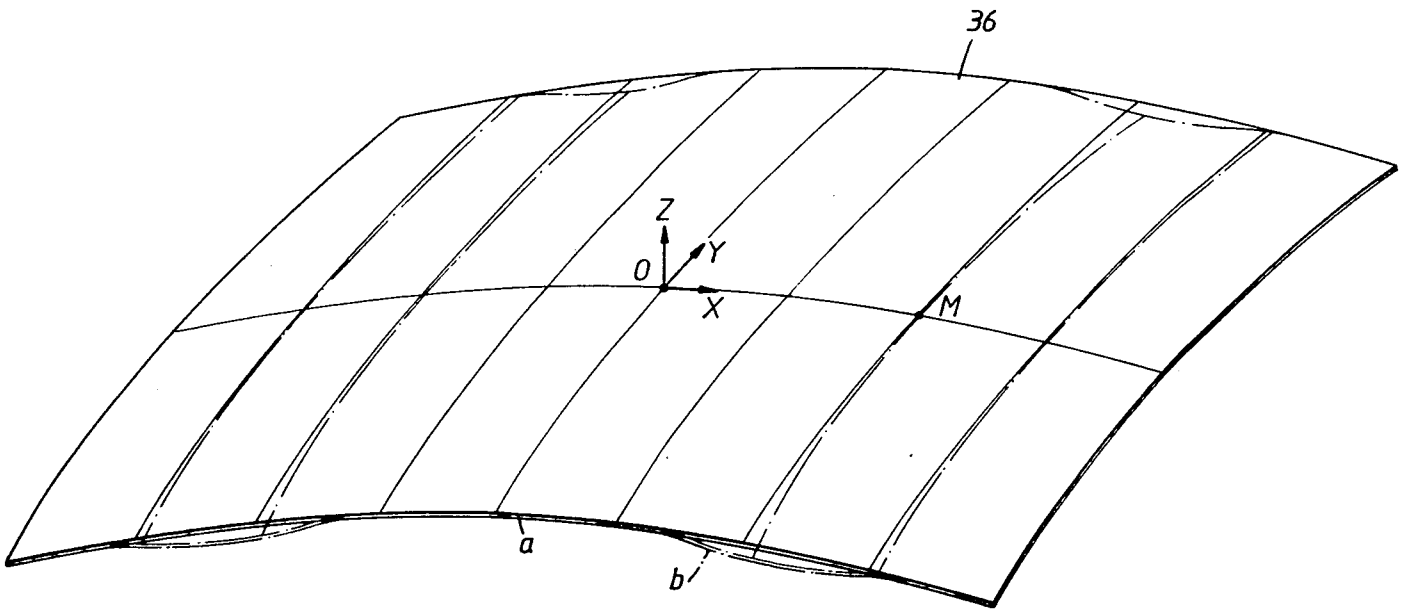
FIG. 4 is a perspective view contrasting the shape of the shadow mask of FIG. 2 with a conventional shadow mask shape.

In the embodiment of the invention shown in FIGS. 1–3, therefore, there is a minimal radius of curvature of line of intersection of a Y-Z parallel plane and the effective area at a position which is between the mask centre 0 and the edge P of the effective area going along the X axis, which, designating the distance between the mask centre 0 and the edge P of the effective area in the ½ plane of the mask as L, is located in the range 0.5 L to 0.9 L. The radius of curvature is made smaller than at the mask centre and at the edge P of the effective area. It is preferable to have a minimal value coming in the range of positions from 0.6 L to 0.8 L. The curved surface shape at 0 on the Y axis and the edge P of the effective area on the X axis is the same as it is conventionally. If, now, the shadow mask curved surface shapes are joined smoothly, the radius of curvature on Y-Z parallel planes has a minimal value at intermediate point M on the X axis. The vicinity of this intermediate point M is an area where local mislanding caused by thermal expansion in greatest. The radius of curvature on the Y-Z parallel plane thus has a great effect on thermal deformation of the shadow mask and since local mislanding is smaller if the radius of curvature is smaller, it has the greatest compensatory effect where mislanding is greatest. It is thus made possible to achieve very effective suppression of local mislanding caused by thermal expansion. FIG. 4 gives a comparison showing a conventional shape a (indicated by the full lines) in which the radius of curvature of the line of mask intersection on the Y-Z parallel plane increases monotonically along the X axis as opposed to the shape b in the embodiment of the invention (which differs in the portions indicated by the dashed lines). For example, in a 21" colour cathode ray tube, going from the expression of continuous raduis of curvature of the Y-Z parallel plane and effective area lines of intersection going along the X axis $$R_V = R_{VO} + kX^2 \quad (3)$$

$R_V$ was made $$R_V = R_{VO} + a_1|X|^2 + a_2|X|^3 + a_3|X|^4 + a_4|X|^5 + a_5|X|^6 \quad (4)$$

and the Z axis component distance MNz between the intermediate point M on the X axis and the points N and N' at opposite edges of the effective area was changed from a 7.8 mm arc to an 8.8 mm arc. $R_{VO}$ here is the radius of curvature on the Y axis and k, $a_1$, $a_2$, $a_3$, $a_4$ and $a_5$ are constants and a change was made from

| | |
|---|---|
| $R_{VO}$ = 1374, | $k = 5.26 \times 10^{-3}$ |
| to | |
| $R_{VO}$ = 1374, | $a_1 = -0.719 \times 10^{-4}$ |
| | $a_2 = -0.208 \times 10^{-5}$ |
| | $a_3 = 0.122 \times 10^{-5}$ |
| | $a_4 = 0.203 \times 10^{-8}$ |
| | $a_5 = -0.104 \times 10^{-10}$ |

In the case, as shown in FIG. 5, the radius of curvature of the effective area cut by a Y-Z parallel plane was changed from curve 3 to curve 4 and was made such that it had a minimal value at an intermediate point M on the X axis that was located at 0.7 L (140 mm from the mask centre). This gave an approximately 20% improvement in mislanding.

It is not essential to change the Z axis component distance MNz between the intermediate point M on the X axis and the points N and N' at opposite edges of the effective area but it is simply necessary to make the shadow mask shape such that the radius of curvature on a Y-Z parallel plane along the Y axis is made minimal in a portion where there is great local mislanding, in a region in the vicinity of the X axis in an intermediate portion of the X axis. However, it is of course easier to make the radius of curvature on a Y-Z prallel plane at an intermediate portion of the X axis small if the Z axis component distance MNz between point M and the effective area opposite edge points N and N' is made larger. As a criterion for the vicinity of the X axis, it is satisfactory if $|Y| < S/6$, where S is the effective width of the effective curved surface portion of the shadow mask.

With a shadow mask that has a structure as indicated by curve 4, there are cases of local departure of the q value from the optimum value but even if the amount of this is outside a permissible value no particular problems result if the shape of the inner surface of the panel is made similar to that of the shadow mask and minimal radius of curvature values on Y-Z parallel planes in the vicinity of the X axis are made to correspond to similar points on the shadow mask. In this case, there is a change in the raster distortion characteristic, etc. but the amount of change is small and causes hardly any problems and in the case of a 21" tube as noted above is something that is not easily discernible with the naked eye. More specifically, taking the screen centre as the point of origin, its major axis as the X axis, its minor axis as the Y axis and the central axis as the Z axis, similarly to what was done for the shadow mask, the shape of the panel inner surface is made such that in the area of the screen that is in the vicinity of the intersection of the screen and the plane including the X axis and Z axis (X-Z plane) minimal values of the radius of curvature of the lines of intersection formed by the screen and arbitrary planes that are parallel to the Y axis and the Z axis (Y-Z parallel planes) exist along the X axis between the screen centre and the screen edges.

As described above, the invention makes it possible for colour purity deterioration caused by local thermal deformation to be effectively suppressed simply by partial change of curved surface shape, without large changes in the shadow mask or panel structure.

What is claimed is:

1. In a colour cathode ray tube which comprises a substantially rectangular curved panel which has a fluorescent screen formed on its inner surface and has its central axis at the centre of and going in a direction normal to this screen and a shadow mask with a non-spherical curved surface which is mounted via a substantially rectangular frame in a position such that the central axis passes through the mask centre and possesses an effective area having formed therein a large number of apertures permitting passage of electron beams, a colour cathode ray tube wherein, taking the mask centre of the shadow mask as a point of origin, its major axis as the X axis, its minor axis as the Y axis and the central axis as the Z axis, that area in the effective area which is in the vicinity of the intersection of the plane containing the X and Z axis (X-Z plane) and the effective area is so shaped that minimal values of the radius of curvature of lines of intersection defined by the effective area and arbitrary planes that are parallel to the Y axis and the Z axis (Y-Z parallel planes) exist along the X axis between the mask centre and the edges of the effective area.

2. Colour cathode ray tube as claimed in claim 1, wherein the shape of the panel inner surface is made such that, taking the screen centre as the point of origin, its major axis as the X axis, its minor axis as the Y axis and the central axis as the Z axis, as for the shadow mask, in the area of the screen that is in the vicinity of the intersection of the screen and the plane including the X axis and Z axis (X-Z plane) minimal values of the radius of curvature of the lines of intersection formed by the screen and arbitrary planes that are parallel to the Y axis and the Z axis (Y-Z parallel planes) exist along the X axis between the scren centre and the edges of the screen.

3. Colour cathode ray tube as claimed in claim 1, wherein designating the effective width of the effective area in the direction of the Y axis as S and distance in the Y axis direction from the X-Z plane and effective area intersection as Y, the area in the vicinity of the intersection defined by the X-Z plane and the effective area in the Y axis direction is made such that, centering about the intersection defined by the X-Z plane and the effective area, the relation $|Y| < S/6$ holds in the Y axis direction.

4. Colour cathode ray tube as claimed in claim 1, wherein, designating the effective width of the screen in the direction of the Y axis as S and distance in the Y axis direction from the X-Z plane and screen intersection as Y, the area in the vicinity of the intersection defined by the X-Z plane and the screen, in the Y axis direction is made such that, centering about the intersection defined by the X-Z plane and the screen the relation $|Y| < S/6$ holds in the Y axis direction.

5. Colour cathode ray tube as claimed in claim 1, wherein, designating the distance from the mask centre to an edge of the effective area going in the direction of the X axis as L, the radius of curvature of the intersections defined by the Y-Z parallel planes and the effective area has minimal values at positions which are at distances of 0.5–0.9 L towards edges of the effective area.

* * * * *